US006644199B2

(12) United States Patent
Goernig et al.

(10) Patent No.: US 6,644,199 B2
(45) Date of Patent: Nov. 11, 2003

(54) IGNITER ELEMENT FOR A PYROTECHNIC CHARGE ON A CIRCUIT CARRIER ARRANGEMENT WITH AN IGNITIOR ELECTRONICS ASSEMBLY

(75) Inventors: Thomas Goernig, Markt-Indersdorf (DE); Holger Wulff, Ingolstadt (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 0 days.

(21) Appl. No.: 10/145,398

(22) Filed: May 13, 2002

(65) Prior Publication Data

US 2002/0166472 A1 Nov. 14, 2002

(30) Foreign Application Priority Data

May 12, 2001 (DE) ..... 101 23 285

(51) Int. Cl.[7] ..... F42C 19/12
(52) U.S. Cl. ..... 102/202.5
(58) Field of Search ..... 102/202.5, 202.7, 102/202.9, 206, 215

(56) References Cited

U.S. PATENT DOCUMENTS

| | | | | |
|---|---|---|---|---|
| 4,869,170 A | * | 9/1989 | Dahmberg et al. | 102/202.5 |
| 5,142,982 A | | 9/1992 | Diepold et al. | |
| 5,495,806 A | * | 3/1996 | Willey | 102/202.14 |
| 5,634,660 A | | 6/1997 | Fink et al. | |
| 5,889,228 A | * | 3/1999 | Ewick et al. | 102/275.5 |
| 5,929,368 A | * | 7/1999 | Ewick et al. | 102/215 |
| 6,079,332 A | * | 6/2000 | Marshall et al. | 102/202.5 |
| 6,082,265 A | * | 7/2000 | Sakamoto et al. | 102/206 |
| 6,085,659 A | | 7/2000 | Beukes et al. | |
| 6,166,452 A | * | 12/2000 | Adams et al. | 307/10.1 |
| 6,227,115 B1 | | 5/2001 | Gruber et al. | |
| 6,324,979 B1 | * | 12/2001 | Troianello | 102/202.7 |
| 6,418,853 B1 | * | 7/2002 | Duguet et al. | 102/206 |

FOREIGN PATENT DOCUMENTS

| | | |
|---|---|---|
| DE | 4002088 | 8/1990 |
| DE | 4435319 | 4/1996 |
| DE | 19629104 | 7/1997 |
| DE | 19610799 | 9/1997 |
| DE | 19805539 | 8/1999 |
| DE | 19836278 | 3/2000 |
| DE | 19836280 | 5/2000 |
| DE | 19951720 | 12/2000 |
| DE | 19930904 | 1/2001 |
| DE | 19940201 | 1/2001 |
| DE | 19940200 | 4/2001 |
| EP | 0279796 | 8/1988 |
| EP | 0555651 | 8/1993 |
| WO | WO97/21067 | 6/1997 |
| WO | WO00/09964 | 2/2000 |
| WO | WO00/40917 | 7/2000 |

OTHER PUBLICATIONS

U. S. patent application Publication No. US 2002/0002924 A1, Publication Date: Jan. 10, 2002, Duguet et al.

* cited by examiner

*Primary Examiner*—Michael J. Carone
*Assistant Examiner*—Troy Chambers
(74) *Attorney, Agent, or Firm*—W. F. Fasse; W. G. Fasse

(57) ABSTRACT

An igniter element and an ignition electronics assembly are mounted and electrically interconnected on a circuit carrier for igniting a pyrotechnic charge, e.g. for deploying an airbag in a motor vehicle. The igniter element (e.g. a layer of ignitable material) is arranged on a carrier body of heat-resistant, thermally insulating material, which is mounted on the circuit carrier. An electrical contact on the carrier body electrically connects the igniter element with the circuit carrier. The carrier body has a standardized configuration, contact arrangement, and dimensions, to be mounted on the circuit carrier like any standardized electronic component using automated equipment. Relative to the contact on the bottom surface, the igniter element can be arranged on a side surface of the carrier body so as to face in a longitudinal direction away from the ignition electronics assembly and toward and into contact with the pyrotechnic charge.

31 Claims, 2 Drawing Sheets

IGNITER ELEMENT FOR A PYROTECHNIC CHARGE ON A CIRCUIT CARRIER ARRANGEMENT WITH AN IGNITIOR ELECTRONICS ASSEMBLY

CROSS-REFERENCE TO RELATED APPLICATIONS

This application is related to U.S. applications Ser. Nos. 10/145,397 and 10/145,399, both filed on May 13, 2002. The entire disclosures of these two other commonly filed U.S. applications are incorporated herein by reference.

PRIORITY CLAIM

This application is based on and claims the priority under 35 U.S.C. §119 of German Patent Application 101 23 285.3, filed on May 12, 2001, the entire disclosure of which is incorporated herein by reference.

FIELD OF THE INVENTION

The invention relates to an igniter element for igniting a pyrotechnic charge or active mass, on a circuit carrier arrangement having an ignition electronics assembly thereon, for example for triggering a gas generator of a passenger or occupant protection device, such as an airbag, in a motor vehicle.

BACKGROUND INFORMATION

Igniter elements for igniting pyrotechnic charges typically comprise a wire that can be ignited by applying an electric voltage thereto. This ignitable wire is arranged or mounted on a circuit carrier arrangement, on which there is further arranged an ignition electronic assembly, which provides the necessary ignition energy and which carries out communication with a databus, for example as disclosed in German Patent DE 196 10 799 C1. It is also known, and becoming more prevalent, to use a layer of ignitable material instead of an ignitable wire, whereby in the prior art such an ignitable layer has always been deposited on the circuit carrier arrangement, for example as disclosed in published European Patent Application EP 0,555,651 B1.

To achieve a further integration of the overall igniter arrangement, German Patent DE 199 40 201 C1 discloses using the surface of a circuit component, for example preferably the surface of an ignition capacitor, as a circuit carrier substrate, on which conductor paths are deposited, and further circuit components including an ignition layer are arranged, to achieve an extremely compact overall construction.

All of the above mentioned igniter arrangements, however, suffer the disadvantage or problem, that a manufacturer of such igniter arrangements must carry out not only the steps of mounting components on the circuit carrier arrangement, but also the steps of forming or depositing the ignition bridge layer, and often also steps of manufacturing or mounting the entire pyrotechnic components. Especially the pyrotechnic zone including the pyrotechnic components of such an igniter arrangement requires especially high safety demands and special equipment and processes for mounting and installing the various components. As a result, the manufacturer must fulfill all applicable safety requirements and must be equipped to carry out various diverse technological processes, including dangerous processes in the field of pyrotechnics.

It is further known in the art to provide a spatial or structural separation of the pyrotechnic zone from the electronic zone in an igniter arrangement, for example as disclosed in the German Patents DE 40 02 088 C1 and DE 198 36 280 C1. In these references, a protective wall is provided as a structural separation element between the pyrotechnic zone and the ignition electronics zone. Additional electrical connections must be established through the protective wall to provide the necessary electrical connection between the two zones on opposite sides of the wall. Therefore, by providing such a protective wall, the electronic assembly may be well-protected and in some cases can even be manufactured independently of the pyrotechnic zone, but it is not possible for the manufacturer of the electronic assembly to completely test the functionality thereof, because the ignition bridge element of course must be arranged in the pyrotechnic zone and must be connected to the rest of the electronic circuitry for being able to test the functionality thereof.

SUMMARY OF THE INVENTION

In view of the above, it is an object of the invention to provide an igniter element arrangement that is easy to manufacture and mount, and that allows a separation of the pyrotechnic components from the electronic components in the fabrication process and technology, while still allowing a complete functional testing of the ignition arrangement to be carried out. The invention further aims to avoid or overcome the disadvantages of the prior art, and to achieve additional advantages, as apparent from the present specification.

The above objects have been achieved according to the invention in an ignition arrangement including a circuit carrier, an ignition electronics assembly mounted on the circuit carrier, an igniter element arrangement mounted on the circuit carrier, and a pyrotechnic charge operatively contacting or connected to the igniter element arrangement. The invention particularly involves an improvement of the igniter element arrangement comprising an igniter element that is mounted on an igniter element carrier body which is separate and distinct from the circuit carrier. The igniter element carrier body comprises contacts or conductors for establishing electrical contact between the igniter element itself and the circuit carrier. The igniter element carrier body is preferably configured and dimensioned with the same shape, size, format, contact configuration, and the like, as other standard electronic components of the ignition electronics assembly, so that the overall igniter element arrangement can essentially be handled and mounted as a standardized electronic component, in the same manner as any other standardized electronic component.

The basic underlying idea of the invention is particularly not to arrange or mount the igniter element directly on the circuit carrier, but rather to provide the igniter element on a carrier body that is separate from the circuit carrier, and then to mount this carrier body on the circuit carrier. This idea may be directly contrary to the general demands for reducing the size and the complexity of igniter arrangements and circuits, but it achieves considerable advantages in the manufacturing and the functional reliability.

The carrier body for carrying the igniter element is preferably a monolithic or integral one-piece component of an electrically non-conductive, heat resistant (i.e. able to withstand the temperatures that arise during ignition and burning of the pyrotechnic charge), and poorly thermally conducting material (i.e. a substantially thermally insulating material, which means a material that is at least as thermally insulating as, and preferably more thermally insulating than, the circuit carrier itself), for example glass or ceramic. The igniter element may be formed from any suitable ignitable material deposited as a layer on the surface of the carrier body, and similarly, the necessary electrical contacts can be established by depositing metallized conductor paths on the surface of the carrier body in any conventionally known manner.

According to the invention, this igniter element carrier body can be designed, embodied and arranged in a standardized manner, with respect to its dimensions, configuration, and electrical contacts, in consideration of the corresponding parameters required by the component mounting devices and the electrical contacting devices, e.g. respective robots, used in the production of the ignition electronics assembly on the circuit carrier. In other words, the igniter element carrier body can be handled and mounted on the circuit carrier as a totally normal standardized circuit component. The pyrotechnically active electrical ignition layer itself on the carrier body is still not particularly a safety concern, as long as it does not come into contact with the pyrotechnic charge or active mass. Thus, the entire circuit carrier with all of the components mounted thereon, including the igniter element arrangement, can be mounted and assembled in normal electronics assembly halls using normal electronics assembly equipment, and can then be transported and stored as a finished assembly without any specialized safety measures, and may further, at any time, be completely tested as to its electrical functionality.

Moreover, the manufacturer of the finished circuit carrier with all of the components mounted thereon can obtain the igniter element arrangement as an externally supplied prefabricated component from a pyrotechnic specialist. Thus, the manufacturer of the overall circuit arrangement does not need to have and operate special equipment or processes for forming the igniter element or mounting it on its carrier body or mounting the carrier body on the substrate. In other words, the igniter element arrangement becomes an independent component that is commercially available as such, which leads to corresponding economies in the manufacturing of the overall ignition arrangement, as well as allowing specialization of the distinct aspects required for the manufacturing of the overall ignition arrangement.

As a further advantage, the carrier body acts as a protection or protective mass between the circuit carrier on the one hand, and the igniter element and the pyrotechnic charge on the other hand. Thus, the interposed carrier body to some extent protects the circuit carrier from the influences (e.g. thermal and mechanical loads) of the burning of the pyrotechnic charge.

The carrier body furthermore makes it possible to achieve a variable configuration or orientation of components during the mounting and assembly, especially with reference to the orientation of the circuit carrier relative to the pyrotechnic charge. Namely, the igniter element or ignition bridge itself does not necessarily need to be provided on the top of the carrier body, but rather can be provided on a side surface of the carrier body, so that an arrangement and orientation of the circuit carrier extending perpendicularly away from the pyrotechnic charge is easily achievable, without requiring complicated mounting receivers or special contacts for the igniter element.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
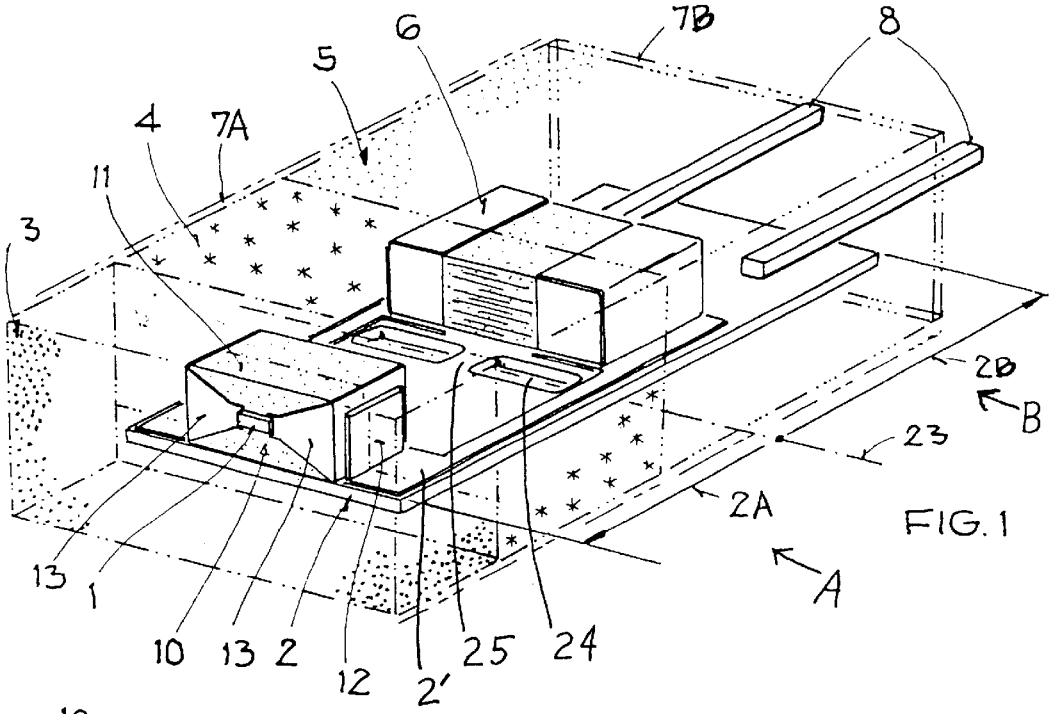
FIG. 1 is a schematic perspective view of an ignition arrangement according to the invention, with an igniter element on a separate carrier body, and a longitudinal orientation of the circuit carrier, whereby the outer housing, the pyrotechnic charge, and encasing materials are shown only with ghost lines for the sake of clarity.

FIG. 1 shows a perspective view, with outer components illustrated with ghost lines, of an especially preferred embodiment of an ignition arrangement that can be used as an igniter for a gas generator of an occupant protection device, for example an airbag in a motor vehicle. The overall ignition arrangement includes a circuit carrier 2 such as a circuit board or substrate 2, an ignition electronics assembly 6 mounted on the circuit carrier 2, an igniter element arrangement 10 with an igniter element in the form of an ignition bridge layer 1 provided on a separate carrier body 11, which in turn is electrically connected via electrical contacts 12 with the circuit carrier 2. This arrangement is enclosed in a housing including a housing canister 7A and a housing lid or cap 7B.

In comparison to a conventional arrangement of an ignition bridge layer directly on a circuit carrier, the inventive igniter element layer 1 is provided on a separate carrier body 11, which can be made of essentially any desired suitable pressure resistant, heat resistant, substantially thermally insulating material, for example ceramic or glass. Due to the inventive separation of the carrier body 11 from the circuit carrier 2, the material of the carrier body 11 can be selected largely free of limitations that would otherwise be imposed by the process requirements or fabrication requirements of other typical circuit carriers.

Moreover, without causing any significant additional costs or complexity, the carrier body 11 can be designed and adapted with respect to its dimensions and configuration to match the other electrical or electronic components mounted on the circuit carrier 2, and particularly the components of the ignition electronics assembly 6. Therefore, the carrier body 11 can be handled, processed, and mounted on the circuit carrier 2 in a single working step, i.e. using a single component mounting machine or robot, together with the other electronic components such as the ignition electronics assembly 6.

Figure 2:
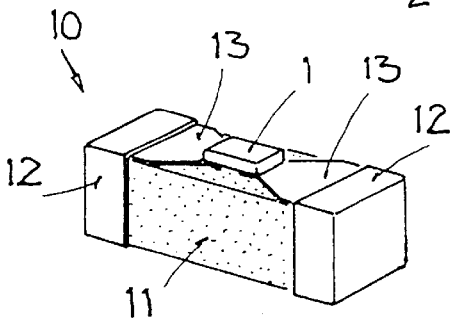
FIG. 2 is a perspective view of an igniter element arrangement with an ignition layer as an igniter element in a surface mount device (SMD) construction.

As an example, FIG. 2 shows such an igniter element arrangement 10 with a carrier body 11 having a configuration and dimensions corresponding to a standard SMD-1206 structure, with contacts 12 enclosing or covering the lateral sides or ends of the carrier body 11, and metallization layers 13 forming electrical conduction paths between the contacts 12 and the ignition bridge layer 1. The contacts 12 may be separate elements relative to the metallization 13, or may simply be specialized integral extensions of the metallizations 13, possibly with additional reflow solder coating layers. These contacts 12 establish the electrical contact with the circuit carrier 2 when the igniter element arrangement 10 is mounted on the circuit carrier 2. Particularly, the contacts 12 of the igniter element arrangement 10 are configured and located in such a manner so that they can be contacted onto the corresponding conductors or contacts 2 of the circuit carrier 2, together with the contacts of the ignition electronics assembly 6, in a single work step or process, for example by means of an SMD reflow soldering process in the present embodiment.

Figure 3:
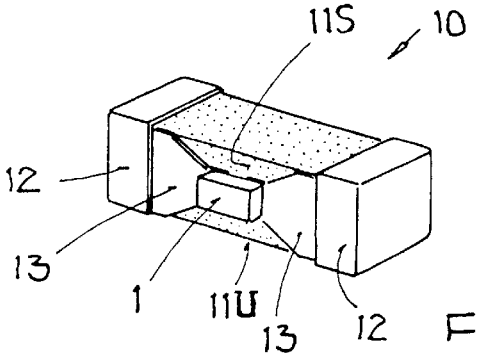
FIG. 3 is a perspective view of an igniter element arrangement with the ignition layer oriented and arranged on a side surface of the carrier body.

FIG. 3 schematically shows that the ignition bridge layer 1 can be arranged on a side surface 11S of the carrier body 11, relative to the contacts 12 provided on the bottom surface 11U of the carrier body 11. Alternatively, this can be understood simply as orienting the igniter element arrangement 10 correspondingly with the ignition bridge layer 1 toward the side, namely simply by rotating the arrangement shown in FIG. 2 by 90° about its longitudinal axis to achieve the installation orientation shown in FIG. 3.

By mounting the igniter element arrangement 10 on the circuit carrier 2 in the orientation as shown in FIG. 3, the especially preferred longitudinal orientation shown in FIG. 1 becomes possible. In that arrangement, the carrier body 11 of the igniter element arrangement 10 is arranged on the top surface of the circuit carrier 2, at a first end thereof, namely at the front or left end as shown in FIG. 1. The igniter element arrangement 10 and the circuit carrier 2 are in contact with the pyrotechnic charge 3 only at this first end of the circuit carrier 2, and everywhere else, are surrounded or encased by an elastic, pressure absorbing and shock absorbing encasing material 4. The side surface 11S of the carrier body 11 having thereon the ignitable material layer 1 forming the actual igniter element is oriented in a direction corresponding to the orientation of this first end, i.e. facing toward and contacting the pyrotechnic charge 3, whereby the ignitable material layer 1 is exposed from and not covered by the encasing material 4. On the other hand, the ignition electronics assembly 6 is arranged on the opposite second end of the circuit carrier 2, at a spacing distance away from the igniter element arrangement 10 and the pyrotechnic charge 3. Thus, already due to the orientation and the spacing distance, the ignition electronics assembly 6 is largely protected from mechanical and thermal influences of the burning of the pyrotechnic charge 3.

Figure 4:
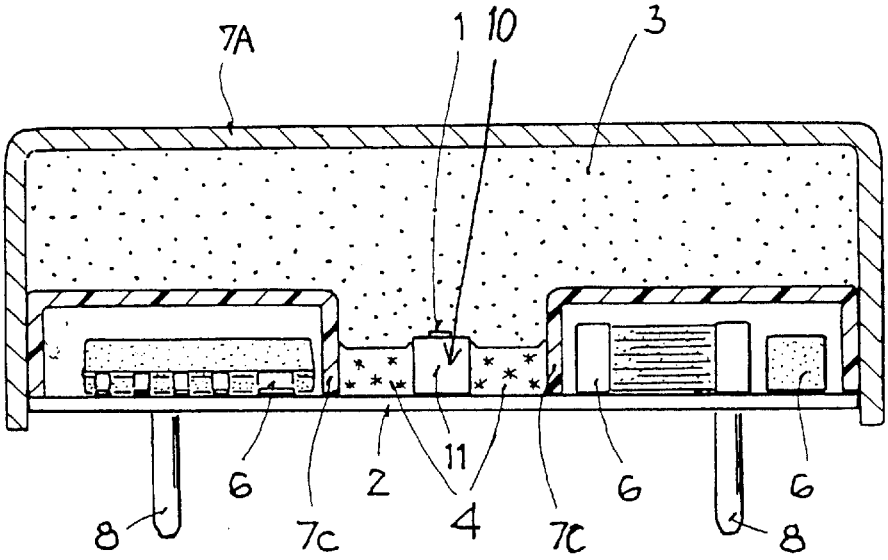
FIG. 4 is a sectional view of an ignition arrangement with an igniter element arrangement in a centered position and a cross-wise orientation.

Furthermore, the pyrotechnic zone A of the overall ignition arrangement including the igniter element arrangement 10, is separated from the electronic zone B including the ignition electronic assembly 6. This separation is provided either by a protective barrier wall 7C (e.g. as shown in FIG. 4), or in an especially preferred embodiment, directly by an encasing 5 of a corresponding pressure resistant and heat resistant material that encases the electronic zone B, as shown in FIG. 1. In such an embodiment, the separation is thus formed as an interface between the preferably softer encasing 4 of the pyrotechnic zone A and the preferably harder encasing 5 of the electronic zone B. The material used for the encasing 4 of the pyrotechnic zone A, i.e. for encasing the circuit carrier 2 in the pyrotechnic zone A, is preferably a soft elastic pressure absorbing material, for example embodied as a so-called "soft glob top". Due to its certain plastic or elastic deformability, this pressure absorbing material 4 protects the portion 2A of the circuit carrier 2 in the pyrotechnic zone A, as well as absorbing and cushioning the mechanical shock from the burning of the pyrotechnic charge 3 before that shock can reach the electronic zone B. Thus, the result is a two-part encasing of the circuit carrier divided into the pyrotechnic zone A and the electronic zone B.

The circuit carrier or substrate 2 in FIG. 1 further includes at least one parting or decoupling feature 23, 24 at a corresponding parting or decoupling location 23, for separating or decoupling the first portion 2A of the circuit carrier 2 located in the pyrotechnic zone A, from the remaining second portion 2B of the circuit carrier 2, after ignition of the pyrotechnic charge 3. Particularly, the one or more parting or decoupling features 23, 24 are so dimensioned, configured, and embodied, so that they will only be separated, i.e. to separate the two portions of the circuit carrier 2, in the event that the applied load exceeds a prescribed thermal and/or mechanical load threshold during the burning of the pyrotechnic charge 3. The complete achieved separation of the circuit carrier or substrate 2 at the parting location 23 can be detected by means of the remaining interrupted conductor ends on the circuit carrier 2, such as a circuit board 2. This physical separation or parting of the circuit carrier 2 at the parting location 23 ensures that no forces, or at least no forces exceeding the load threshold, are transmitted through the circuit carrier 2 from the pyrotechnic zone A to the electronic zone B and particularly to the electronic components making up the electronic assembly 6.

The circuit carrier or substrate 2 may, for example, be made of ceramic material with suitable metal layers deposited thereon to form conductor path structures and contact zones 2', e.g. in the manner of any typically known circuit board, and the decoupling or parting feature 23, 24 can be embodied in this substrate as a frangible or intentionally breakable link between the two portions 2A and 2B of the circuit carrier 2, as shown in FIG. 1.

Particularly, in the illustrated embodiment of FIG. 1, two cut-out oblong holes 24 are provided in the circuit carrier substrate 2 along the parting line 23, so as to weaken the structure of the circuit carrier substrate 2 at this location, so that the substrate will break along the parting line 23 if a load exceeding the designed load threshold is applied to the first portion 2A of the substrate relative to the second portion 2B thereof. The load threshold can be selected during fabrication, based on the dimensions, configuration, number, and placement of the holes 24, for example, and the corresponding characteristics of the frangible links or integral tabs 25 remaining to interconnect the two portions 2A and 2B of the substrate between the holes 24.

The electronic assembly 6 comprises electronic components or elements for controlling the igniter arrangement via an energy and databus, with which the igniter arrangement is connected by means of contacts or pins 8, a protective circuit that provides protection against interferences on the data bus, and an ignition energy reserve or store, especially an ignition capacitor, as well as any suitable additional electronic circuit components or elements. The particular make-up of the electronic assembly is not critical for the invention, and it may be in accordance with any conventionally known electronic assembly for an igniter arrangement. It is simply important that the electronic assembly is arranged on the second portion 2B of the circuit carrier 2 so that after decoupling or separation of the parting feature 23, 24 at the parting location 23, to separate the pyrotechnic first portion 2A of the circuit carrier 2 with the igniter element arrangement 10 from the remainder of the circuit carrier 2, the electronic assembly will still be able to carry out its other functions, for example especially a self-diagnosis function as well as databus communication, and at least will not hinder or interfere with the external data exchange on the bus system.

As in the above described embodiment, the circuit carrier may comprise an integral one-piece substrate 2, with merely a weakened area forming the parting or decoupling feature at the parting location 23. Alternatively, the circuit carrier 2 may comprise two separate substrate portions or members 2A and 2B, that are connected to each other along the parting location 23, for example by a soldered connection that is established during the assembly or installation of the igniter arrangement. Due to the heat generated during the burning of the pyrotechnic charge 3, the soldered connection or connections along the parting location 23 will melt or soften so as to achieve a separation or decoupling and thereby prevent the further transmission of loads from the first member 2A to the second member 2B of the circuit carrier 2.

In this embodiment, the at least one solder connection is so dimensioned and embodied (e.g. with a suitable solder material) so that it is able to withstand the mechanical and thermal demands that arise in the motor vehicle field of application, and also is able to conduct the required ignition current to the igniter element 1, without melting or softening. However, the mechanical and thermal energy being released by the burning of the ignited pyrotechnic charge 3 is significantly greater than the ordinary mechanical and thermal operating loads, so that the at least one solder connection can be initially dimensioned and embodied with an adequate safety factor above the expected operating loads, while still ensuring a proper separation or decoupling once the pyrotechnic charge 3 is ignited. This is especially true because merely a softening, without complete melting, of the soldered connection is sufficient to bring about a decoupling that prevents the further transmission of forces from the pyrotechnic zone A to the electronic zone B through the parting location 23 of the circuit carrier 2.

The circuit carrier 2 in FIG. 1 is preferably further at least partially surrounded or enclosed by a pressure absorbing material 4 in the pyrotechnic zone A as mentioned above. This pressure absorbing material 4 is softer than the material of the separating protective wall 7C or the encasing 5 of the electronic zone B. For example, this pressure absorbing material 4 may be embodied in the manner of a so-called "soft glob top", which has a certain plastic or elastic deformability which serves to protect both the first portion 2A of the circuit carrier 2 located in the pyrotechnic zone A as well as the protective wall 7C or the encasing 5 from the pressure forces or shock generated by the burning pyrotechnic charge 3. Therefore, the pressure resistance or strength of the protective wall 7C or the encasing 5 can be reduced when using such a pressure absorbing material 4, or the total security and reliability of the overall arrangement can be correspondingly increased.

As especially seen in FIG. 1, the pressure absorbing material 4 particularly preferably forms a buffer or cushion between the pyrotechnic charge 3 and the electronic zone B of the arrangement. The pressure absorbing material 4 is sufficiently elastic, so that when the load on the pyrotechnic first portion 2A of the circuit carrier 2 exceeds the acceptable threshold load, the parting feature at the parting location 23 will be separated, without hindrance from the pressure absorbing material 4.

Figure 5:
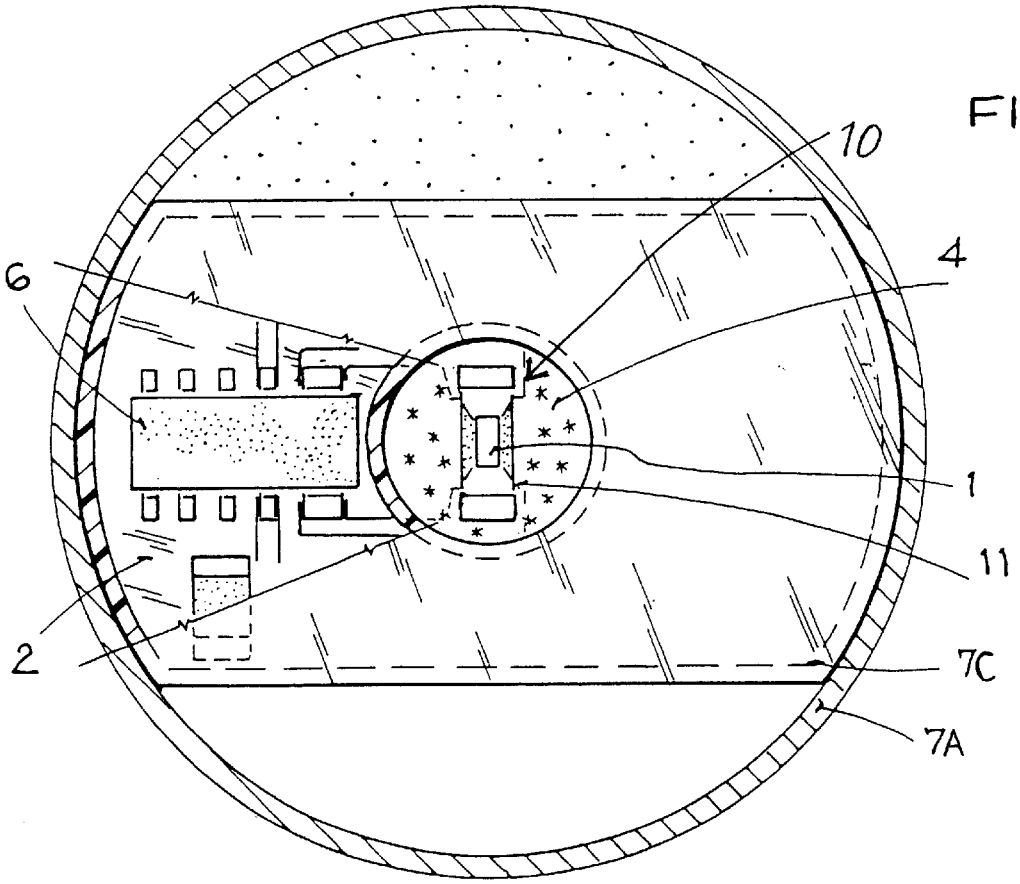
FIG. 5 is a partially sectioned-open top plan view of the circuit carrier according to FIG. 4.

FIGS. 4 and 5 show an alternative arrangement or mounting configuration of the overall ignition arrangement using an igniter element arrangement 10 having an igniter element or ignition layer 1 arranged on a separate carrier body 11, which in turn is arranged on a circuit carrier 2 that extends longitudinally in a direction perpendicular to the orientation of the carrier body 11. The igniter element arrangement 10 is arranged on the top surface of the circuit carrier 2, at the center thereof, while the components of the ignition electronics assembly 6 are arranged on the top surface of the circuit carrier 2 laterally outwardly around the igniter element arrangement 10. An additional protective wall 7C forming a capsule encloses and protects the ignition electronics assembly 6. A pressure absorbing material 4 surrounds and encases the igniter element arrangement 10, except for the areas of the ignitable material layer or igniter element 1, which remains free and exposed from the pressure absorbing material 4. The pyrotechnic charge 3 is arranged above or on top of the protective wall 7C and the igniter element arrangement 10, so as to be in contact with the actual igniter element 1.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In a pyrotechnic ignition arrangement for igniting a pyrotechnic charge, including a circuit carrier, an ignition electronics assembly with at least one electronic component mounted on said circuit carrier, and an igniter element arrangement that is adapted to ignite the pyrotechnic charge and that is connected to said circuit carrier and thereby electrically connected to said ignition electronics assembly, an improvement wherein said igniter element arrangement comprises a carrier body that is a discrete separate part relative to said circuit carrier, an igniter element that is arranged on said carrier body and adapted to ignite the pyrotechnic charge, and an electrical contact arrangement that electrically connects said igniter element arrangement with said circuit carrier, and wherein said carrier body has a configuration that extends longitudinally along a longitudinal axis and that is standardized and has a degree of symmetry such that said carrier body can be selectively mounted and electrically contacted onto said circuit carrier in any one of plural possible orientations with different rotations of said carrier body about said longitudinal axis.

2. The improvement in the pyrotechnic ignition arrangement according to claim 1, wherein said carrier body is a monolithic body of a material that is electrically non-conductive, heat resistant and substantially thermally insulating.

3. The improvement in the pyrotechnic ignition arrangement according to claim 2, wherein said material of said carrier body consists of a ceramic or a glass.

4. The improvement in the pyrotechnic ignition arrangement according to claim 2, wherein said carrier body is shaped as a rectangular block, and said igniter element and said electrical contact arrangement are arranged on an outer surface of said carrier body.

5. The improvement in the pyrotechnic ignition arrangement according to claim 1, wherein said configuration of said carrier body has dimensions corresponding to a standardized configuration and standardized dimensions of an electronic component among said at least one electronic component.

6. The improvement in the pyrotechnic ignition arrangement according to claim 5, wherein said standardized configuration and said standardized dimensions are in accordance with the SMD-1206 component standard.

7. The improvement in the pyrotechnic ignition arrangement according to claim 1, wherein said electronic component of said ignition electronics assembly has a standardized configuration and standardized dimensions and is adapted to be mounted on said circuit carrier by an automated component mounting machine, and wherein said carrier body of said igniter element arrangement also has said standardized configuration and said standardized dimensions and is also adapted to be mounted on said circuit carrier by the same automated component mounting machine.

8. The improvement in the pyrotechnic ignition arrangement according to claim 7, wherein said electrical contact arrangement is configured, arranged and adapted to be electrically contacted onto said circuit carrier in a single process cycle together with said electronic component of said ignition electronics assembly being electrically contacted onto said circuit carrier.

9. The improvement in the pyrotechnic ignition arrangement according to claim 8, wherein said electrical contact arrangement is adapted to be electrically contacted onto said circuit carrier by SMD soldering.

10. The improvement in the pyrotechnic ignition arrangement according to claim 1, wherein said electrical contact arrangement comprises a contact pad and a conductor electrically connecting said contact pad with said igniter element.

11. The improvement in the pyrotechnic ignition arrangement according to claim 10, wherein said contact pad and said conductor are respectively formed as a metallization layer deposited on an outer surface of said carrier body.

12. The improvement in the pyrotechnic ignition arrangement according to claim 10, wherein said contract pad includes a layer of reflow solderable solder material, and said igniter element arrangement is electrically connected to said circuit carrier by reflow soldering said solder material to electrically connect said contact pad with said circuit carrier.

13. The improvement in the pyrotechnic ignition arrangement according to claim 10, wherein said contact pad is arranged on an end face of said carrier body that is intersected by a longitudinal axis of said carrier body.

14. The improvement in the pyrotechnic ignition arrangement according to claim 13, wherein said contact pad is further arranged extending from said end face onto at least one side face of said carrier body that extends parallel to said longitudinal axis.

15. The improvement in the pyrotechnic ignition arrangement according to claim 14, wherein said contact pad is further arranged extending onto two side faces, a top face and a bottom face of said carrier body that each extend parallel to said longitudinal axis.

16. The improvement in the pyrotechnic ignition arrangement according to claim 1, wherein said igniter element comprises a layer of ignition material deposited on said carrier body in contact with said electrical contact arrangement.

17. The improvement in the pyrotechnic ignition arrangement according to claim 16, wherein said electrical contact arrangement comprises a contact on a bottom surface of said carrier body, and said layer of ignition material is arranged on a side surface of said carrier body relative to said bottom surface.

18. The improvement in the pyrotechnic ignition arrangement according to claim 1, wherein said carrier body is mounted on a top surface of said circuit carrier at a center of said circuit carrier with said igniter element facing perpendicularly upward away from said circuit carrier, wherein said ignition electronics assembly is mounted on said top surface of said circuit carrier laterally outwardly displaced from said carrier body, and further comprising said pyrotechnic charge arranged above said circuit carrier, above said ignition electronics assembly and above said carrier body and in contact with said igniter element.

19. An igniter element arrangement for igniting a pyrotechnic charge, comprising:

a carrier body having a standardized configuration and standardized dimensions corresponding to a standardized electronic component adapted to be mounted on a circuit carrier;

an igniter element that is arranged on said carrier body and adapted to ignite a pyrotechnic charge when an ignition voltage is applied to said igniter element; and an electrical contact arrangement that is arranged on said carrier body, and that includes a contact pad adapted to be electrically connected with the circuit carrier and an electrical conductor connecting said igniter element with said contact pad;

wherein said contact pad is arranged rotationally symmetrically on said carrier body with respect to stepwise angular rotations of said carrier body about a longitudinal axis thereof, so that said carrier body can be selectively mounted and electrically contacted onto the circuit carrier in any one of plural possible orientations with different rotations about said longitudinal axis.

20. The igniter element arrangement according to claim 19, wherein said carrier body is a solid monolithic block of an electrically and thermally insulating material, and said igniter element and said electrical contact arrangement are respectively arranged on an outer surface of said solid monolithic block.

21. The igniter element arrangement according to claim 19, wherein said material comprises a material selected from the group consisting of ceramics and glasses.

22. The igniter element arrangement according to claim 19, wherein said igniter element comprises a layer of ignitable material deposited on an outer surface of said carrier body, and said electrical conductor comprises a metallization layer deposited on said outer surface of said carrier body in contact with said layer of ignitable material.

23. The igniter element arrangement according to claim 19, wherein said stepwise angular rotations are 90° rotations of said carrier body about said longitudinal axis thereof, so that said carrier body can be selectively mounted and electrically contacted onto the circuit carrier in any one of plural possible orientations with different 90° rotations about said longitudinal axis.

24. The igniter element arrangement according to claim 23, wherein said carrier body has an end surface perpendicular to said longitudinal axis, and said end surface has a square elevation shape.

25. The igniter element arrangement according to claim 19, wherein said carrier body has an end surface perpendicular to said longitudinal axis, and said end surface has an equilateral polygon elevation shape.

26. The igniter element arrangement according to claim 19, wherein said contact pad is arranged on an end surface of said carrier body perpendicular to said longitudinal axis.

27. The igniter element arrangement according to claim 26, wherein said electrical contact arrangement further includes plural side contacts, a top contact and a bottom contact respectively extending from said contact pad onto side surfaces, a top surface and a bottom surface of said carrier body parallel to said longitudinal axis.

28. A combination of the igniter element arrangement according to claim 19 and the circuit carrier, wherein said carrier body is mounted on said circuit carrier in such an orientation so that said igniter element is arranged on a side surface of said carrier body extending perpendicularly relative to a plane of said circuit carrier.

29. In a pyrotechnic ignition arrangement for igniting a pyrotechnic charge, including a circuit carrier, an ignition electronics assembly with at least one electronic component mounted on said circuit carrier, and an igniter element arrangement that is adapted to ignite the pyrotechnic charge and that is connected to said circuit carrier and thereby electrically connected to said ignition electronics assembly, an improvement wherein said igniter element arrangement comprises a carrier body that is a discrete separate part relative to said circuit carrier, an igniter element that is arranged on said carrier body and adapted to ignite the pyrotechnic charge, and an electrical contact arrangement that electrically connects said igniter element arrangement with said circuit carrier, and wherein said carrier body is mounted on said circuit carrier in such an orientation so that said igniter element is arranged on a side surface of said carrier body extending perpendicularly relative to a plane of said circuit carrier.

30. In a pyrotechnic ignition arrangement for igniting a pyrotechnic charge, including a circuit carrier, an ignition electronics assembly with at least one electronic component mounted on said circuit carrier, and an igniter element arrangement that is adapted to ignite the pyrotechnic charge and that is connected to said circuit carrier and thereby electrically connected to said ignition a electronics assembly, an improvement wherein said igniter element arrangement comprises a carrier body that is a discrete separate part relative to said circuit carrier, an igniter element that is arranged on said carrier body and adapted to ignite the pyrotechnic charge, and an electrical contact arrangement that electrically connects said igniter element arrangement with said circuit carrier, wherein said circuit carrier has opposite first and second ends with an extension axis extending from said first end to said second end, said carrier body is mounted on said circuit carrier at said first end with said igniter element oriented facing in a direction along said extension axis away from said second end, and said ignition electronics assembly is mounted on said circuit carrier at said second end at a spacing distance away from said igniter element with said carrier body therebetween.

31. The improvement in the pyrotechnic ignition arrangement according to claim 30, further comprising said pyrotechnic charge arranged adjacent to said first end of said circuit carrier in contact with said igniter element and in contact with said circuit carrier only at said first end.

* * * * *

UNITED STATES PATENT AND TRADEMARK OFFICE

CERTIFICATE OF CORRECTION

PATENT NO. : 6,644,199 B2
DATED : November 11, 2003
INVENTOR(S) : Goernig et al.

It is certified that error appears in the above-identified patent and that said Letters Patent is hereby corrected as shown below:

Title page, Item [54] and Column 1, line 3,
After "AN", replace "IGNITIOR" by -- IGNITION --;

Title page,
Item [56], References Cited, U.S. PATENT DOCUMENTS, between "5,889,228 A" and "5,929,368 A" insert -- 5,942,717 A * 8/1999 Pathe et al. --.

Column 5,
Line 7, after "contacts", replace "2" by -- 2' --.

Column 10,
Line 33, before "wherein", replace "19," by -- 20, --.

Signed and Sealed this

Sixteenth Day of March, 2004

JON W. DUDAS
*Acting Director of the United States Patent and Trademark Office*